US006031186A

United States Patent [19]

Sakich et al.

[11] Patent Number: 6,031,186

[45] Date of Patent: Feb. 29, 2000

[54] SOLID POLYMER INSULATORS WITH EYE AND CLEVIS ENDS

[75] Inventors: John D. Sakich, Wadsworth; Viorel Berlovan, Jr., North Royalton; Randall K. Niedermier, Akron, all of Ohio

[73] Assignee: Hubbell Incorporated, Orange, Conn.

[21] Appl. No.: 08/947,751

[22] Filed: Oct. 9, 1997

Related U.S. Application Data

[63] Continuation of application No. 08/545,332, Oct. 19, 1995, abandoned.

[51] Int. Cl.[7] ..... H01B 17/58; H01B 17/06

[52] U.S. Cl. ..... 174/167; 174/178; 174/177; 174/207; 174/158 R; 174/179

[58] Field of Search ..... 174/176, 177, 174/178, 179, 194, 196, 137 R, 139, 158 R, 167, 169, 170, 207

[56] References Cited

U.S. PATENT DOCUMENTS

| | | | |
|---|---|---|---|
| D. 202,785 | 11/1965 | Vose | D13/131 |
| D. 219,590 | 12/1970 | Vose | D13/131 |
| 1,709,477 | 4/1929 | Kyle | 174/165 |
| 2,234,737 | 3/1941 | Mace | 174/151 |
| 3,110,759 | 11/1963 | Moussou | 174/182 |
| 3,483,314 | 12/1969 | Harmin | 174/140 R |
| 3,531,580 | 9/1970 | Foster | 174/152 R |
| 3,898,372 | 8/1975 | Kalb | 174/179 |
| 4,243,628 | 1/1981 | Herold | 264/275 |
| 4,973,798 | 11/1990 | Parraud et al. | 174/176 |
| 5,233,132 | 8/1993 | Soucille | 174/179 |
| 5,406,033 | 4/1995 | Pazdirek | 174/176 |

FOREIGN PATENT DOCUMENTS

| | | |
|---|---|---|
| 1932949 | 1/1971 | Germany . |

*Primary Examiner*—Kristine Kincaid
*Assistant Examiner*—Kamand Cuneo
*Attorney, Agent, or Firm*—Jerry M. Presson; Mark S. Bicks; Alfred N. Goodman

[57] ABSTRACT

An insulator in the form of suspension insulator or pin type insulator has an elongated load sustaining body with a plurality of weathersheds extending radially relative to the longitudinal axis of the body on the outer surface of the body. The body and weathersheds are unitarily formed as one piece of rigid dielectric plastic polymer which are molded together. Clevis and eye coupling means are provided on the ends of the body to facilitate connection to support structures and high voltage lines.

4 Claims, 3 Drawing Sheets

SOLID POLYMER INSULATORS WITH EYE AND CLEVIS ENDS

This is a continuation of application Ser. No. 08/545,332 filed Oct. 19, 1995 now abandoned.

FIELD OF THE INVENTION

The present invention relates to insulators in the form of high voltage suspension insulators and pintype insulators having elongated, load sustaining bodies with weathersheds extending radially from the bodies and with a coupling on at least one longitudinal end of the body. More particularly, the invention relates to such insulators where the bodies and the weathersheds are unitarily formed as one piece of rigid dielectric polymer plastic.

BACKGROUND OF THE INVENTION

High voltage suspension insulators are used to suspend power transmission lines from overhead supports on poles and towers. Older suspension insulators are made of strings of porcelain insulators having a size and shape required of that material to provide the necessary mechanical strength, dielectric strength and creepage distance. To provide the necessary mechanical and electrical characteristics, porcelain insulators are heavy. Moreover, such porcelain insulators are expensive to install, and require stronger supporting structures. Additionally, porcelain is brittle and subject to damage during shipment and installation.

Newer insulators are formed of a fiberglass reinforced polymer rod and an external protective housing forming the weathersheds. The weathershed housing is usually made of an elastomer or an epoxy material. Elastomer or epoxy weathershed housings are designed to protect the fiberglass reinforced rods from weather and electrical activity. Weather and electrical activity degrade the mechanical strength of the fiberglass reinforced rods. The weathersheds on the housings intercept water flow down the insulators and increase the distance along the surface of the insulator for better electrical performance in wet or contaminated conditions.

Metal end fittings are attached to the fiberglass rod either by epoxy or by crimping the metal fittings to the fiberglass rod, as disclosed for example in U.S. Pat. No. 3,898,372 to Kalb, the subject matter of which is hereby incorporated by reference. The mechanical strength of this insulator is dependent upon the strength of the fiberglass rod, the connection of the rod to the metal end fittings and the strength of the end fittings. Such strength is generally 15,000 pounds or greater.

SUMMARY OF THE INVENTION

An object of the present invention is to provide an insulator having a solid or non-hollow core of rigid dielectric plastic polymer having radially extending weathersheds and at least one coupling at one end.

A further object of the present invention is to provide an insulator having a body with radially extending weathersheds and coupling means at one end thereof which is simple to manufacture, light weight, provides the desired mechanical and electrical characteristics at minimum cost, and is easy to handle and install.

The foregoing objects are basically obtained by an insulator comprising an elongated load sustaining body having an outer surface, first and second longitudinal ends and a longitudinal axis. A plurality of weathersheds extend radially relative to the longitudinal axis on the outer surface of the body. The body and weathersheds are unitarily formed of one piece of rigid, dielectric plastic polymer. First end coupling means are located at the first end of the body.

By forming the insulator in this manner, the entire insulator can be formed substantially in one step by a single molding process. The rigid dielectric plastic polymer is molded of the appropriate size, to provide the desired mechanical strength. The strength is determined by the nature of the plastic polymer material used and the minimum cross-sectional area of the insulator. If metal end fittings are included or molded into the body, such end fittings and their connections to the body will also be considered in determining the overall strength of the insulator.

By forming the insulator in this manner, the fiberglass reinforced rod of conventional suspension insulators can be eliminated. By eliminating the housing-rod interface and the use of separate materials for forming the weathershed housing and the load bearing fiberglass reinforced polymer rod, the exposure to degrading from contamination is avoided.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 2:
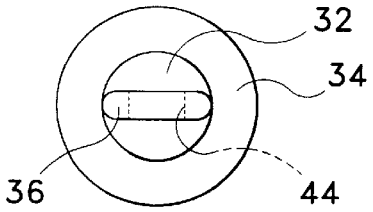
FIG. 2 is a top plan view of the suspension insulator of FIG. 1.

Referring initially to FIGS. 1–4, high voltage suspension insulator 30 consists of a single, one-piece unitarily molded member of rigid, dielectric plastic polymer. The insulator comprises an elongated load sustaining body 32 and a plurality of weathersheds 34 extending radially outwardly relative to the longitudinal axis of the body and on the outer surface of the body. End couplings 36 and 38 extend from the body axially at the opposite longitudinal ends of the body.

High voltage suspension insulator 30 is formed of a single polymer material such that it is able to sustain the mechanical load. The plastic polymer can be a thermoplastic material or a thermosetting material. Exemplary materials are polypropylene, polyethylene, epoxy and rubber plastic blends. These plastic polymers can be mechanically reinforced with fiberglass or other reinforcing materials, and can be filled with substances such as hydrated alumina (aluminum trihydrate, ATH) to enhance electrical performance.

One example of a suitable polymer plastic is a composite of the following:

| | Percent By weight |
|---|---|
| Polyethylene | 15–80 |
| Aluminum Trihydrate | 0–75 |
| Fiberglass | 0–45 |
| Kevlar-Aramid Fiber | 0–5 |
| Silicone Rubber | 0–60 |
| Ethylene-Propylene Rubber or Ethylene-Propylene Diene Rubber | 0–25 |
| Silicon Dioxide | 0–10 |
| Titanium Dioxide | 0–10 |
| Compatiblizers, Antioxidants Coagents, Stabilizers and Miscellaneous Additives | 0.1–10 |

Another example of a suitable polymer plastic is a composite of the following:

| | Percent By weight |
|---|---|
| Polyethylene | 0–80 |
| Aluminum Trihydrate (Flame Retardants) | 0–80 |
| Silicone Rubber | 0–60 |
| Ethylene-Propylene Rubber or Ethylene-Propylene Diene Rubber and/or Ethylene-Vinyl Acetate Rubber/Plastic | 0–80 |

-continued

| | Percent By weight |
|---|---|
| Silicon Dioxide | 0–40 |
| Titanium Dioxide | 0–40 |
| Compatiblizers, Antioxidants Coagents, Peroxides, Coupling Agents, Stabilizers and Miscellaneous Additives | 0.1–20 |

In the above examples, the polyethylene, ethylene-propylene rubber and ethylene-propylene diene rubber can be traditional or metallocene catalyzed.

In the first embodiment illustrated in FIGS. 1–4, end couplings 36 and 38 are formed as eyes which are unitarily formed with the body and weathersheds. Specifically, each coupling includes an axially extending lug 40 or 42 having a through bore 44 or 46, respectively, extending traverse to the body longitudinal axis. One of the end coupling is connected to a support structure, while the other end coupling is coupled to a high voltage line.

The strength of the insulator is determined by the strength of the particular polymer employed and the minimum cross-section of the insulator. The insulator can be manufactured by such common polymer molding methods as injection molding, transfer molding or compression molding.

Figure 6:
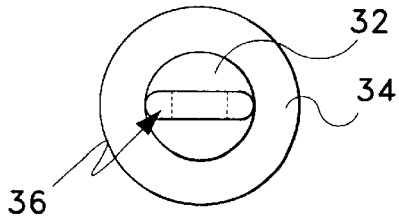
FIG. 6 is a top plan view of the suspension insulator of FIG. 5.
Figure 1:
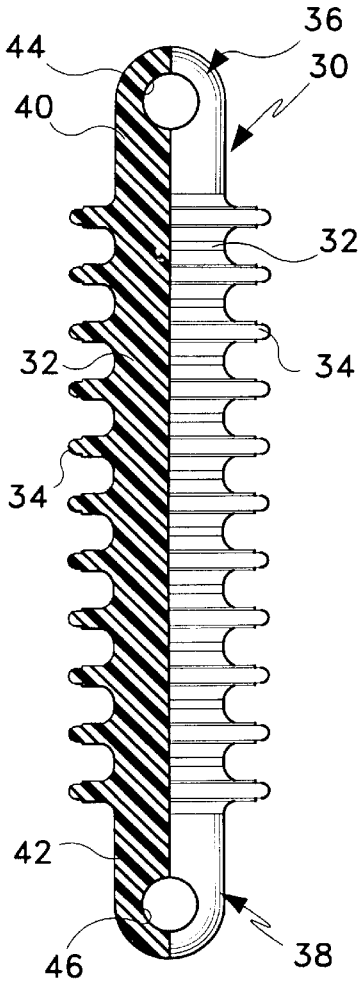
FIG. 1 is a front elevational view, partially in section, of a suspension insulator according to a first embodiment of the present invention.
Figure 4:
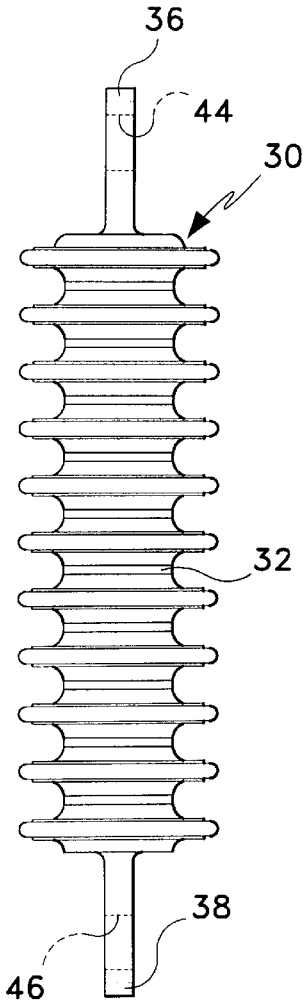
FIG. 4 is a side elevational view of the suspension insulator of FIG. 1.
Figure 5:
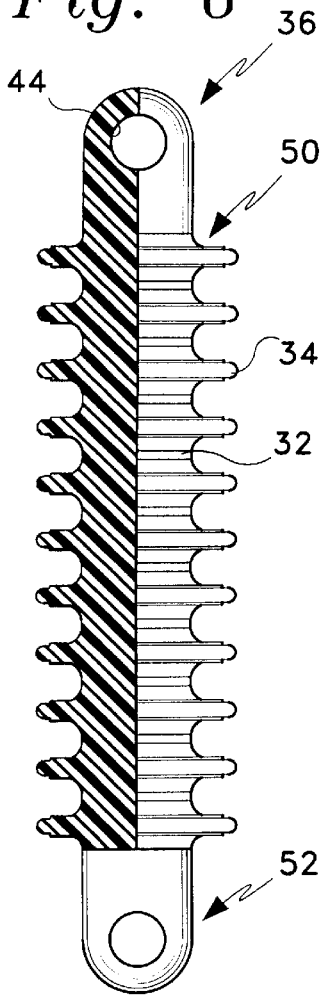
FIG. 5 is a front elevational view, partially in section, of a suspension insulator according to a second embodiment of the present invention.
Figure 3:
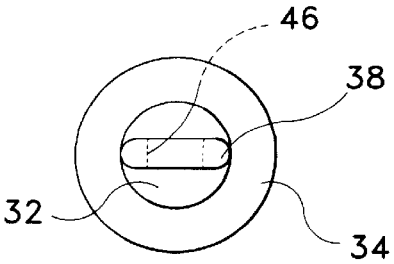
FIG. 3 is a bottom plan view of the suspension insulator of FIG. 1.
Figure 7:
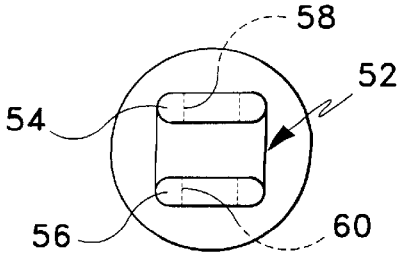
FIG. 7 is a bottom plan view of the suspension insulator of FIG. 5.

A second embodiment of the present invention is provided by the high voltage suspension insulator 50 illustrated in FIGS. 5–7. Features of insulator 50 which are similar to those of insulator 30 are identified by like referenced numbers.

Like insulator 30, insulator 50 consists of a single, one-piece unitary molded member of rigid dielectric plastic polymer. The insulator comprises an elongated load sustaining body 32 with radial weathersheds 34. An end coupling 36 in the form of an eye is located at one end of the insulator. The opposite end of the insulator has a clevis end coupling 52. Clevis end coupling 52 comprises two laterally spaced, axially extending, parallel lugs 54 and 56. The lugs have through bores 58 and 60, respectively. The axes of bores 58 and 60 are parallel to the axis of bore 44 in lug 36, which axes are transverse to the longitudinal axis of body 32 of insulator 50. End coupling 52, like end coupling 36 on the opposite end of insulator 50, is formed as an unitary one-piece part of the entire insulator.

One end coupling can be attached to a support structure, while the other end coupling of insulator 50 is connected to a high voltage line.

Figure 9:
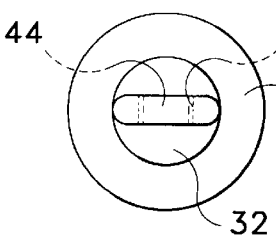
FIG. 9 is a top plan view of the suspension insulator of FIG. 8.
Figure 12:
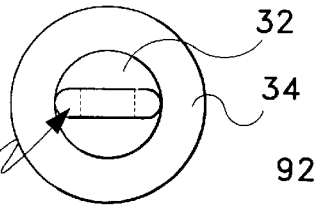
FIG. 12 is a top plan view of the suspension insulator of FIG. 11.
Figure 8:
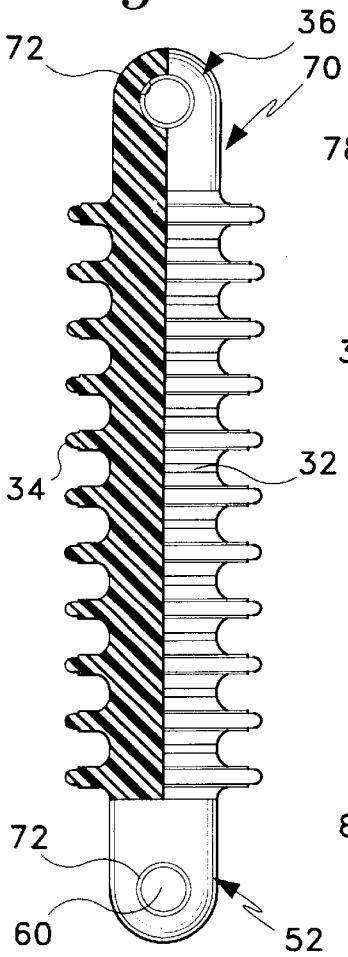
FIG. 8 is a front elevational view, partially in section, of a suspension insulator according to a third embodiment of the present invention.
Figure 11:
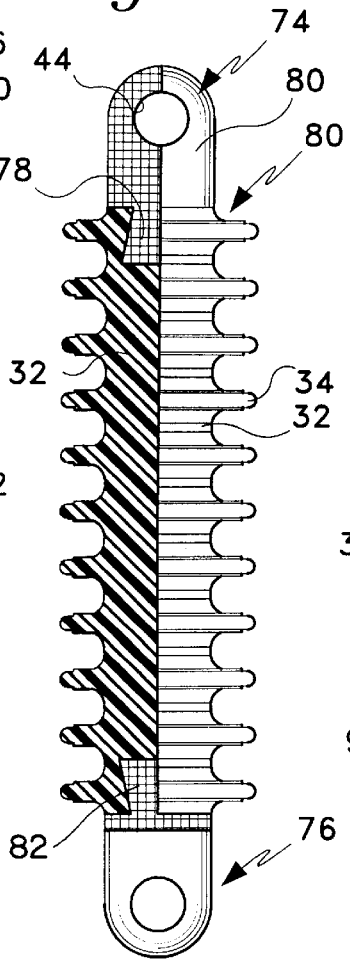
FIG. 11 is a front elevational view of a suspension insulator, partially in section, according to a fourth embodiment of the present invention.
Figure 10:
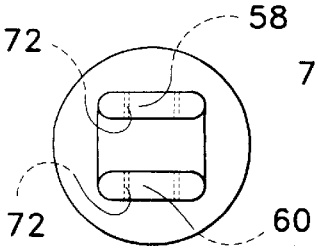
FIG. 10 is a bottom plan view of the suspension insulator of FIG. 8.
Figure 13:
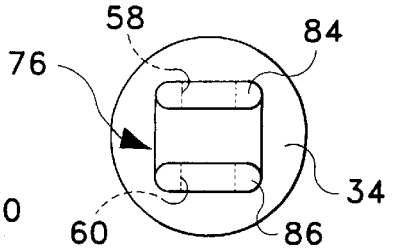
FIG. 13 is a bottom plan view of the suspension insulator of FIG. 11.

FIGS. 8–10 illustrate a suspension insulator 70 having a body 32, weathersheds 34 and end couplings 36 and 52 as disclosed above in connection with insulator 50 of FIGS. 5–7. However, metal inserts or end fittings are molded into end couplings 36 and 52. Specifically, the end fittings are cylindrical metal bushings 72 located within bores 44, 58 and 60. In this manner, metal fittings are located in the locations of the insulator of maximum potential wear to enhance the operative life of the insulator.

FIGS. 11–17 illustrate a high voltage suspension insulator 80 which comprises an elongated load sustaining body 32 with radially extending weathersheds 34. Body 32 and weathersheds 34 are formed of the same material and in the same manner as disclosed above in connection with insulator 30. The insulator is provided with an eye end coupling 74 and a clevis end coupling 76. Rather than the end couplings being unitary extensions of the body, end couplings 74 and 76 comprise metal inserts or fittings which are molded into the solid core of body 32. Coupling 74 comprises a frustroconical base 78 which tapers toward an external lug 80 extending along the longitudinal axis of the insulator. Base 76 is wholly embedded within the solid core of the insulator body during the molding operation. Lug 80 has a transverse bore 44. Similarly, clevis end coupling 76 has a frustroconical base 82 tapering toward external lugs 84 and 86. Lugs 84 and 86 have transverse bores 58 and 60. Lugs 84 and 86 extend parallel to one another and are parallel to the longitudinal axis of the insulator and are spaced in the same manner as the lugs 54 and 56 of insulator 50.

Figure 15:
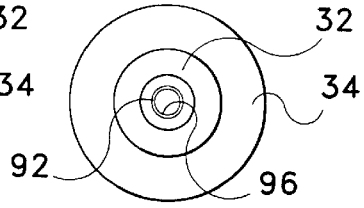
FIG. 15 is a top plan view of the suspension insulator of FIG. 14.
Figure 14:
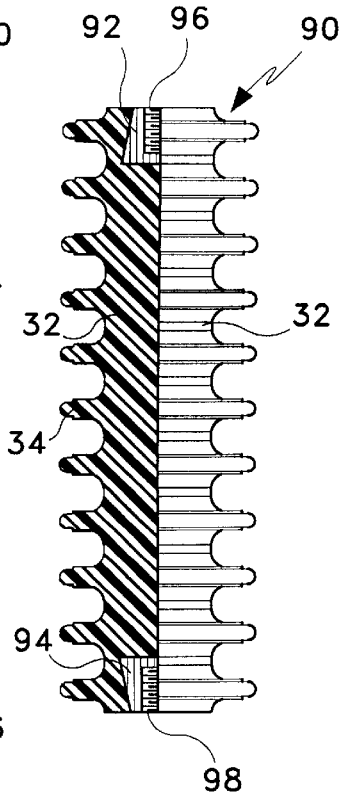
FIG. 14 is a front elevational view, partially in section, of a suspension insulator according to a fifth embodiment of the present invention.
Figure 16:
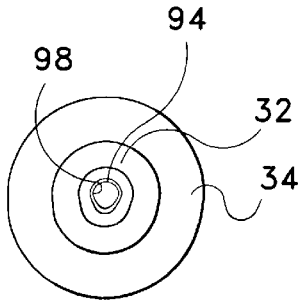
FIG. 16 is a bottom plan view of the suspension insulator of FIG. 14.

FIGS. 14–16 disclose a high voltage suspension insulator 90 having an elongated load sustaining body 32 with radially extending weathersheds 34 formed of the same material and in the same manner as disclosed above in connection with insulator 30. The end couplings for insulator 90 are provided by frustroconical metal fittings or inserts 92 and 94. Each insert tapers towards its exposed free end at the longitudinal end of the insulator, and is molded in place when the body and weathersheds are molded. The fittings have internally threaded bores 96 and 98, respectively. An eye bolt or other type of connector can be threaded into each end of insulator 90 to facilitate connection to a support structure at one end and a high voltage line at the other end of the insulator.

Figure 17:
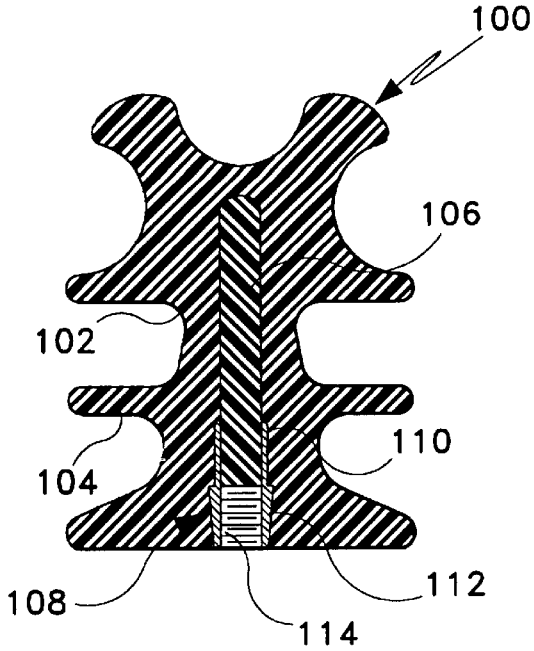
FIG. 17 is a side elevational view, in section, of a pintype insulator according to a sixth embodiment of the present invention.

FIG. 17 discloses a pintype insulator 100 having an elongated load sustaining body 102 and radially extending weathersheds 104. The body and weathersheds are unitarily molded out of the same materials used for the insulator body and weathersheds of insulator 30. One end of the insulator is closed by the body core.

Body 102 of insulator 100 is non-hollow in that a fiberglass rod 106 with a metal insert 108 is located within the body. The body and weathersheds are unitarily molded about rod 106 and metal insert 108. The metal insert has an inner ferrule end 110 crimped to rod 106 and an outer end 112 with an internally threaded bore 114. The internally threaded bore opens on the planar end of the insulator, and allows insulator 100 to be coupled on an end of a threaded rod.

Figure 18:
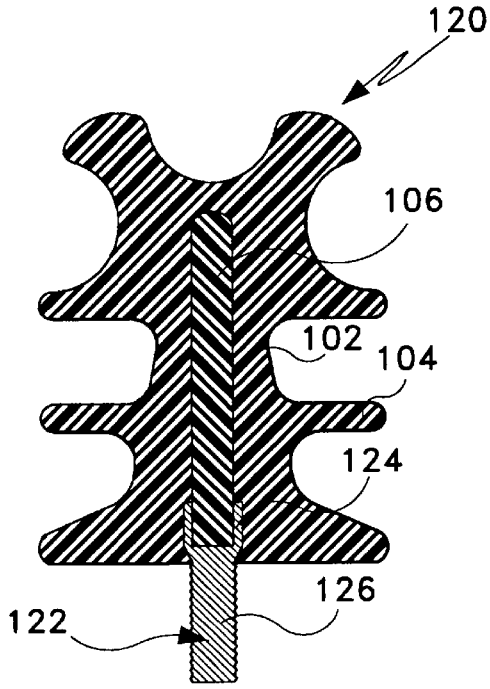
FIG. 18 is a side elevational view, in section, of a pintype insulator according to a seventh embodiment of the present invention.

FIG. 18 discloses a pintype insulator 120 having a body 102 and weathersheds 104 formed in the same manner disclosed above in connection with insulator 100. Additionally, a fiberglass rod 106 with a metal insert 122 is molded within the body. Fitting 122 has an inner end 124 in the form of a ferrule which is crimped to one end of fiberglass rod 106 and has an outer end 126 in the form of an externally threaded member which extends along the body longitudinal axis from the insulator planar end. The externally threaded member is adapted to facilitate connection of insulator 120 to a threaded bore.

Figure 19:
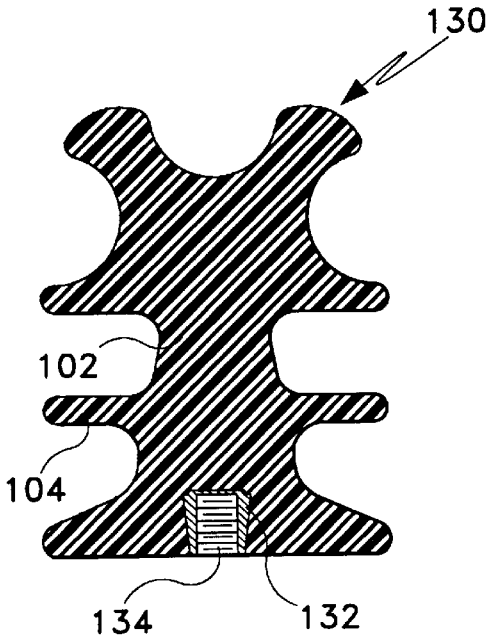
FIG. 19 is a side elevational view, in section, of a pintype insulator according to an eighth embodiment of the present invention.

FIG. 19 discloses a pintype insulator 130 having a solid core body 102 with radially extending weathersheds 104 formed in the same manner as insulator 100. A coupling in the form of frustroconical metal fitting 132 is molded in place at one planar end of insulator 130. Fitting 132 has an internally threaded bore 134 which opens on the planar end of the pintype insulator.

Figure 20:
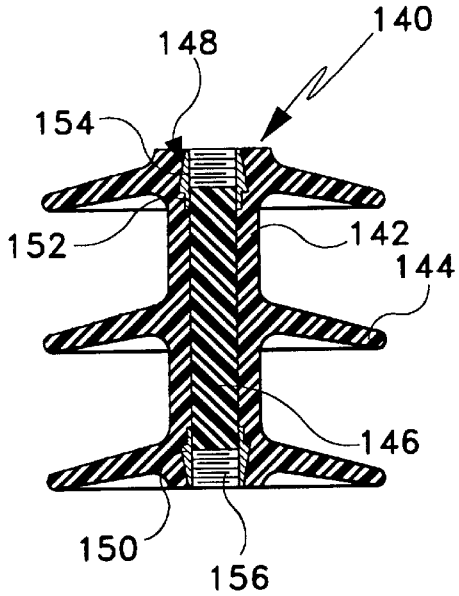
FIG. 20 is side elevational view, in section, of an insulator according to a ninth embodiment of the present invention.

FIG. 20 illustrates a non-hollow core polymer, pintype insulator 140. Insulator 140 has a body 142 of the same material as insulator body 32 of insulator 30, and has unitary radially extending weathersheds 144. Molded within body 142 is a fiberglass rod 146 and metal fittings 148 and 150. The fittings form the end couplings for insulator 140. Each fitting has an inner end 152 in the form of a ferrule crimped to an axial end of rod 146, and an outer end 154 which is frustroconical and tapers away from rod 146. Each outer end has an internally threaded bore 156 opening on a planar axial end of the insulator body for facilitating connection to an externally threaded member.

Fittings 148 and 150 are crimped and secured to fiberglass rod 146, and then the rod-metal fitting assembly is placed in a mold for the unitary molding of the body and weathersheds about the rod and end fittings. Fittings 148 and 150 can be modified to provided an externally threaded member as shown for example by the fitting 122 in FIG. 18, in lieu of the internally threaded fittings illustrated in FIG. 20.

Particularly for the embodiments of FIGS. 1–16 and 19, the vast majority of the body comprises a unitary, homogeneous core. The cross-section of the body transverse to its longitudinal axis is solid i.e., not hollow, and is of uniform material throughout.

In connection with the embodiments including a fiberglass rod (FIG. 17, 18 and 20), the rod is merely provided to enhance attachment of the fitting or fittings forming the end coupling or couplings. The load is absorbed or borne by the body as unitary formed with the weathersheds or rigid, dielectric plastic polymer.

While various embodiments have been chosen to illustrate the invention, it will be understood by those skilled in the art that various changes and modifications can be made therein without departing from the scope of the invention as defined in the appended claims.

What is claimed is:

1. An insulator, comprising:

an elongated load sustaining body of rigid, dielectric plastic polymer, said body having an outer surface, first and second longitudinal ends, a longitudinal axis and a cross-section transverse to said longitudinal axis, said cross-section being solid and of uniform material throughout;

a plurality of weathersheds extending radially relative to said longitudinal axis on said outer surface of said body, said weathersheds being unitarily formed and simultaneously molded of said rigid dielectric plastic polymer as one piece with said body;

an eye at said first end of said body, said eye being symmetrical to said longitudinal axis and unitarily formed and simultaneously molded as one piece with said body; and a clevis at said second end of said body, said clevis being symmetrical to said longitudinal axis and unitarily formed and simultaneously molded as one piece with said body.

2. An insulator according to claim 1 wherein said plastic polymer is selected from the group consisting of thermosetting and thermoplastic materials.

3. An insulator according to claim 1 wherein said plastic polymer is selected from the group consisting of polypropylene, polyethylene, epoxy and rubber plastic blends.

4. An insulator according to claim 1 wherein metal bushings are molded into said eye and said clevis.

* * * * *